US009505468B2

(12) United States Patent
Schopfer

(10) Patent No.: US 9,505,468 B2
(45) Date of Patent: Nov. 29, 2016

(54) FLOATING PLATFORM

(71) Applicant: E. Kevin Schopfer, Boston, MA (US)

(72) Inventor: E. Kevin Schopfer, Boston, MA (US)

( * ) Notice: Subject to any disclaimer, the term of this patent is extended or adjusted under 35 U.S.C. 154(b) by 132 days.

(21) Appl. No.: 14/250,476

(22) Filed: Apr. 11, 2014

(65) Prior Publication Data

US 2014/0216324 A1 Aug. 7, 2014

Related U.S. Application Data

(63) Continuation-in-part of application No. PCT/US2012/059752, filed on Oct. 11, 2012.

(60) Provisional application No. 61/545,738, filed on Oct. 11, 2011.

(51) Int. Cl.

| | |
|---|---|
| ***B63B 35/00*** | (2006.01) |
| ***B63B 35/34*** | (2006.01) |
| ***B63B 35/44*** | (2006.01) |

(52) U.S. Cl.

CPC ..... *B63B 35/00* (2013.01); *B63B 35/34* (2013.01); *B63B 35/44* (2013.01)

(58) Field of Classification Search

CPC ..... B63B 5/14; B63B 5/16; B63B 5/18; B63B 35/34; B63B 35/38; B63B 35/44; B63B 35/4413; B63B 2035/4426; B63B 2035/4493; B63B 35/53; E02B 3/06; E02B 3/062; E02B 3/064

USPC ..... 114/263, 266, 267; 405/218–221

See application file for complete search history.

(56) References Cited

U.S. PATENT DOCUMENTS 3,779,192 A * 12/1973 Gonzalez ..... B63B 35/38 114/266

3,938,461 A 2/1976 Marriner (Continued)

FOREIGN PATENT DOCUMENTS

WO WO 2013/055919 4/2013

OTHER PUBLICATIONS

International Search Report and Written Opinion; PCT/US2015/025258; Jul. 7, 2015; 10 pp.

(Continued)

*Primary Examiner* — Ajay Vasudeva

(74) *Attorney, Agent, or Firm* — Fish & Richardson P.C.

(57) ABSTRACT

A floating platform includes multiple flotation block elements arranged in a general grid pattern, and a structural body supported buoyantly by the flotation elements. An assemblage of floating platforms are joined by one or more connector elements each having a cylindrical body extending across a control joint between opposed sidewall surfaces of adjacent floating platforms. The cylindrical body has a first portion received within a first cylindrical disc assembly secured by a first clamp element and fixedly attached to a first of the opposed sidewall surfaces. The cylindrical body also has an opposite, second end portion received within a second cylindrical disc assembly secured by a second clamp element and fixedly attached to a second of the opposed sidewall surfaces, opposite to the first of the opposed sidewall surfaces. The cylindrical body may be a flexible, or the cylindrical body may be relatively stiff or rigid.

13 Claims, 3 Drawing Sheets

(56) References Cited

U.S. PATENT DOCUMENTS

| | | | | |
|---|---|---|---|---|
| 4,265,193 | A * | 5/1981 | Sluys | B63B 5/14 114/266 |
| 4,318,361 | A | 3/1982 | Sluys | |
| 4,988,317 | A | 1/1991 | Rubinsak et al. | |
| 5,050,524 | A * | 9/1991 | Kyhl | B63B 35/34 114/263 |
| 5,213,447 | A * | 5/1993 | Srock | B63B 35/34 114/266 |
| 5,235,929 | A * | 8/1993 | Chester | B63C 1/02 114/266 |
| 5,713,296 | A | 2/1998 | Gervasi et al. | |
| 6,029,845 | A * | 2/2000 | Mueller | A47G 23/02 220/560 |
| 6,199,502 | B1 * | 3/2001 | Mattson | B63B 5/18 114/266 |
| 6,761,124 | B1 | 7/2004 | Srinivasan | |
| 6,971,327 | B2 * | 12/2005 | Mattson | B63B 3/06 114/266 |
| 6,994,048 | B1 | 2/2006 | Jennings | |
| 7,156,038 | B2 * | 1/2007 | Brown | B63B 35/34 114/267 |
| 2005/0103250 | A1 | 5/2005 | Thomson | |
| 2010/0124461 | A1 | 5/2010 | Danskine | |
| 2011/0044765 | A1 | 2/2011 | Johanneck et al. | |

OTHER PUBLICATIONS

International Search Report; PCT/US2012/059752; Jan. 11, 2013; 2 pp.

Written Opinion; PCT/US2012/059752; Jan. 11, 2013; 6 pp.

* cited by examiner

FLOATING PLATFORM

This application is a continuation-in-part of International Patent Application No. PCT/US2012/059752, filed Oct. 11, 2012 and designating the United States (now pending), which claims priority from U.S. Provisional Application No. 61/545,738, filed Oct. 11, 2011. The complete disclosures of both applications are incorporated herein by reference.

TECHNICAL FIELD

This disclosure relates to floating (buoyant) platforms, and to assemblages of multiple floating platforms joined by flexible connectors.

BACKGROUND

Floating platforms, e.g. rafts and the like, including assemblages of multiple such floating platforms joined together, have been described, including for supporting residences and other structures associated with land-based living. One such assemblage is described in U.S. Provisional Application No. 61/420,495, filed Dec. 7, 2010, the complete disclosure of which is incorporated herein by reference.

SUMMARY

According to one aspect of the disclosure, a floating (buoyant) platform comprises multiple flotation block elements arranged in a general grid pattern, and a structural body supported buoyantly by the floatation elements.

Implementations of this aspect of the disclosure may include one or more of the following additional features. The flotation block elements are formed of foamed polymeric material. The foamed polymeric material is selected from among syntactic foam and expanded polyethylene. One or more of the flotation block elements defines an upwardly tapering surface. The upwardly tapering surface defined by one or more of the flotation block elements further defines indentations. The structural body is formed of reinforced concrete. For example, the structural body is formed of precast concrete and the multiple flotation block elements are received into cavities formed in the precast structural body, or the multiple flotation block elements are arranged in a predetermined pattern and the structural body is formed about the flotation block elements. The platform further comprises sidewalls defining sidewall surfaces, and further comprises a topping slab defining a construction surface. The sidewalls are formed of reinforced concrete. The topping slab is formed of reinforced concrete. The topping slab further comprises multiple structural column bases.

According to one aspect of the disclosure, an assemblage of floating (buoyant) platforms comprises one or more connector elements comprising: a cylindrical body extending across a control joint between opposed sidewall surfaces of adjacent floating platforms, the cylindrical body having a first portion received within a first cylindrical disc assembly secured by a first clamp element and fixedly attached to a first of the opposed sidewall surfaces, and the cylindrical body having an opposite, second end portion received within a second cylindrical disc assembly secured by a second clamp element and fixedly attached to a second of the opposed sidewall surfaces, opposite to the first of the opposed sidewall surfaces.

Implementations of this aspect of the disclosure may include one or more of the following additional features. The cylindrical body is a flexible cylindrical body, formed, e.g., of reinforced rubber or other suitable synthetic material. The cylindrical body is formed of stainless steel or other suitable stiff or rigid material Features and advantages of the disclosure include providing a method and apparatus for creating a floating platform that can be used in singular and/or in multiple (joined together) applications, for supporting buildings, parks, swimming pools, and other activities associate with land-based development, on all manner of bodies of water.

Another feature of the disclosure is providing the SEA BOLT™ flexible platform connector assembly for joining two or more floating platforms with a desired degree of control across the intervening joints, and allowing for dynamic wave and wind loading action.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
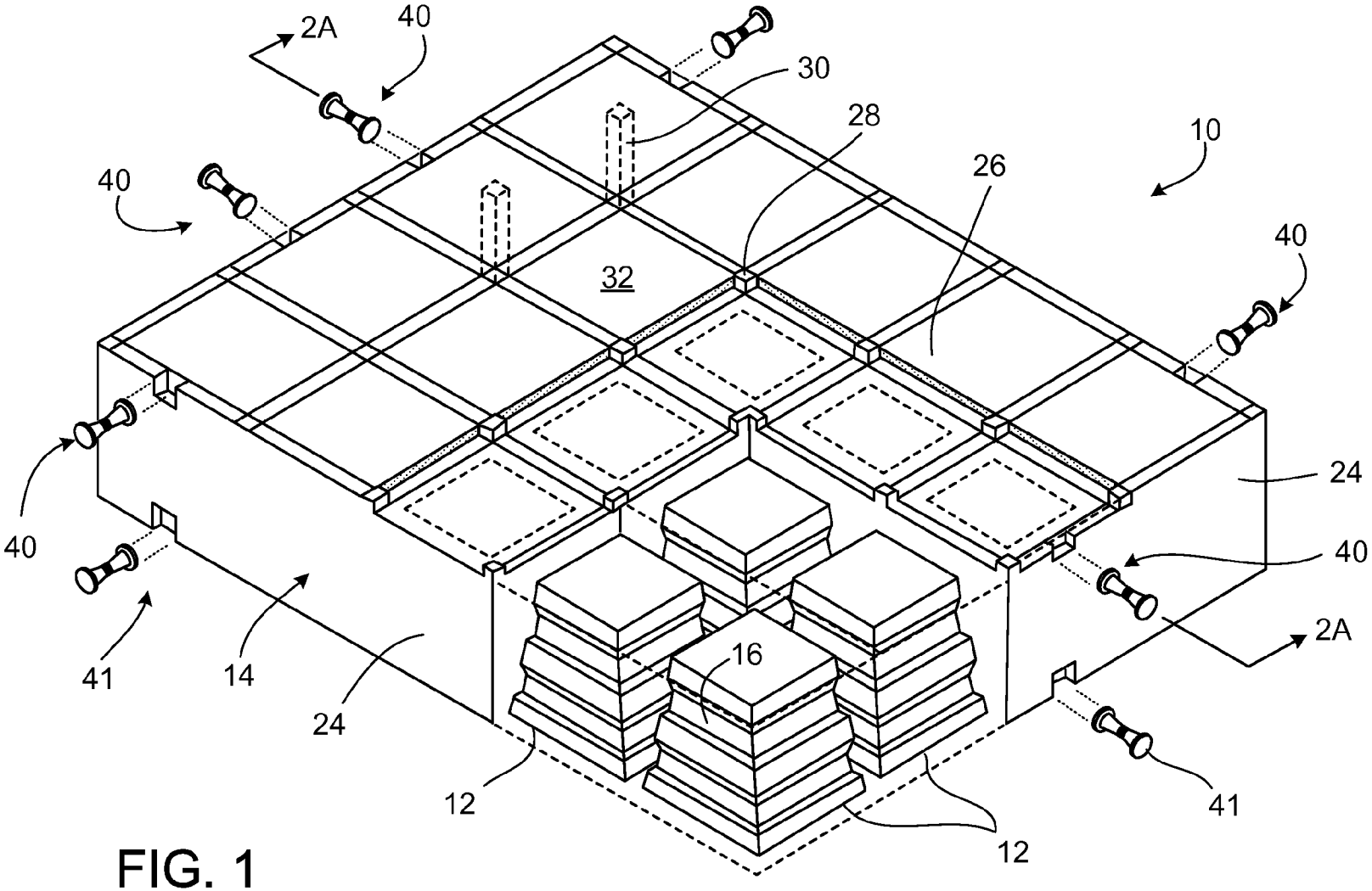
FIG. 1 is a somewhat schematic, isometric view, taken partially in section, of floating platform of this disclosure, with flexible SEA-BOLT™ platform connector assembly, e.g. for joining adjacent floating platforms, shown in expanded view.

Referring to FIG. 1, a floating platform 10 of the disclosure is constructed of a plurality of flotation blocks 12 disposed in a predetermined arrangement, e.g. a general grid pattern, within a relatively rigid body 14 formed, e.g., of reinforced concrete. The flotation blocks 12 are formed of a buoyant material such as syntactic foam, expanded polystyrene, or other suitable material, and have a shape defining an upwardly tapering surface 16 with a series of indentations 18. The rigid structural body 14 of reinforced concrete surrounds and retains, and is buoyantly supported by, the flotation blocks 12. In one implementation of the disclosure, the reinforced concrete forming the structural body 14 may be poured about the arrangement of flotation blocks 12 and allowed to cure and harden in place. In another implementation, the structural body 14 may be precast with apertures 20 (FIG. 2) provided in a predetermined arrangement for receiving the flotation blocks 12. The structural body 14 of reinforced concrete has side walls defining sidewall surfaces 24, and further includes a topping slab 26, also formed of reinforced concrete. Column bases 28 are encompassed within the structural body 14 and positioned generally between the locations of the flotation blocks 12 to provide support for structural columns 30 for construction, e.g., of building structures (not shown) upon the surface 32 of the topping slab 26, and supported by the floating platform 10.

Figure 2:
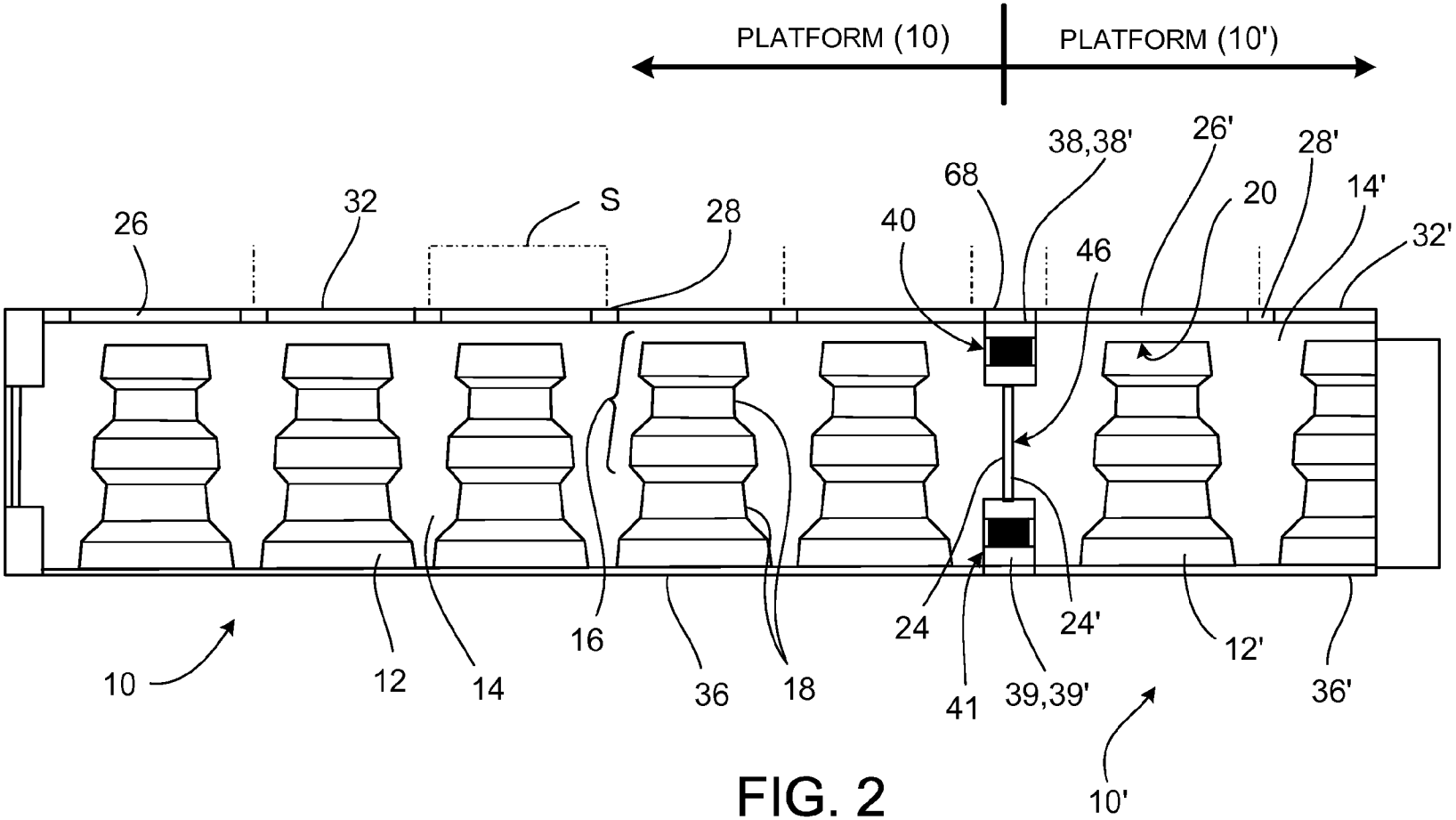
FIG. 2 is a side section view of a pair of adjacent, joined floating platforms of the disclosure, taken along the line 2A-2A of the floating platform of FIG. 1.

Referring also to FIG. 2, an assemblage of two floating platforms 10, 10' is seen in cross section, with the flotation blocks 12, 12' distributed in a selected, predetermined arrangement or spacing, S, within the respective rigid structural bodies 14, 14', and between the topping slabs 26, 26' defining the topping slab construction-supporting surfaces 32, 32'. Column bases or tie-ins 28, 28' are also positioned to receive and support construction columns. A sealant membrane 36, 36' covers the undersurface of each floating platform 10, 10'.

Figure 3:
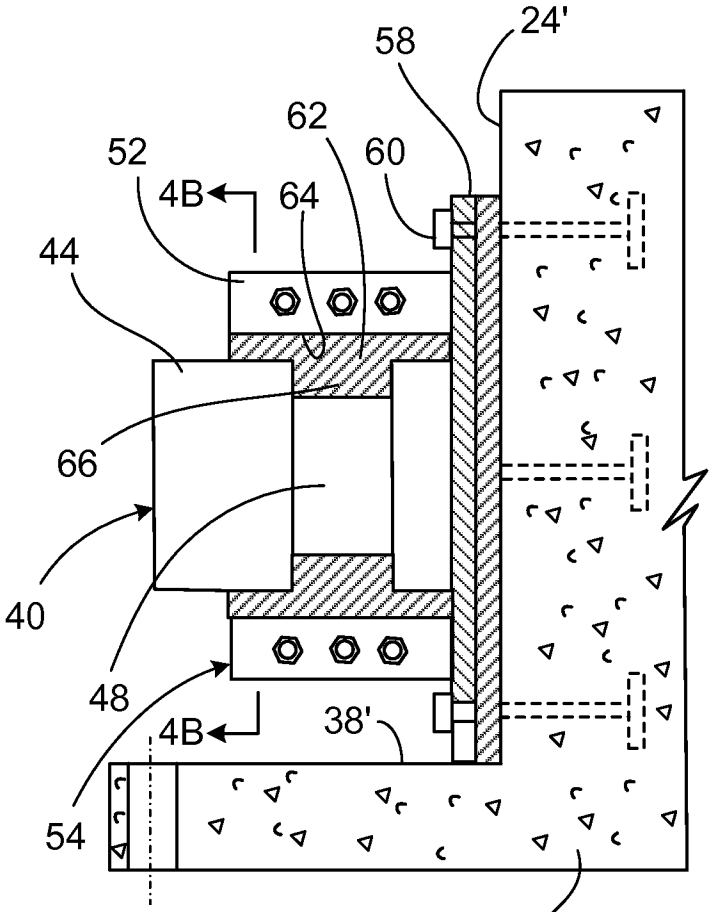
FIG. 3 is a side section view of a flexible SEA-BOLT™ platform connector assembly shown mounted in a connection cavity of a floating platform of the disclosure.
Figure 4:
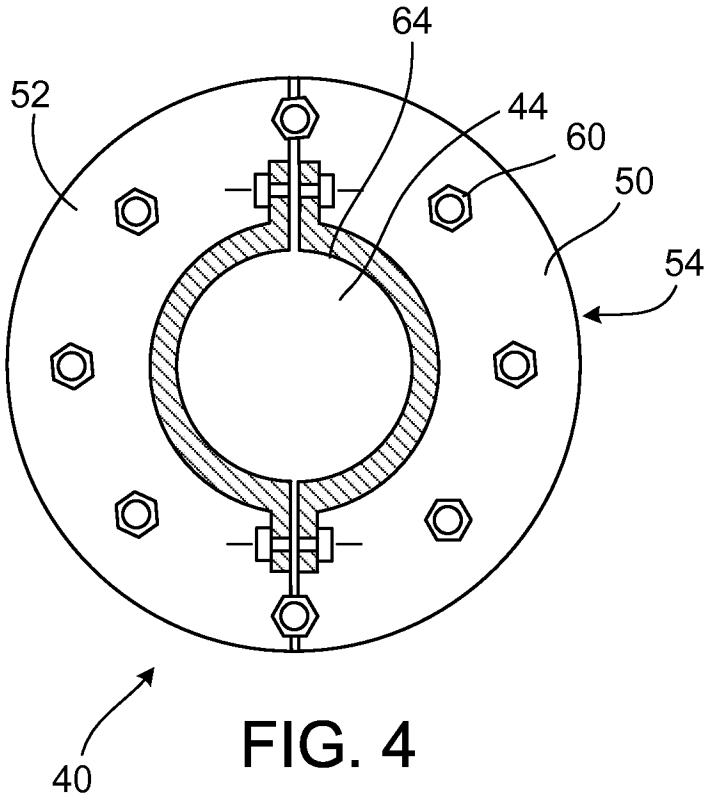
FIG. 4 is an end section view of the flexible SEA-BOLT™ connector assembly of FIG. 3, taken along the line 4B-4B.

Referring to FIG. 2, and also to FIG. 1, the opposed side wall surfaces 24, 24' of adjacent rigid structural bodies 14, 14' define upper and lowers pairs of cooperating platform connector assembly cavities 38, 38' and 39, 39'. The cavities are provided for receiving the opposite ends of upper and lower SEA-BOLT™ platform connector assemblies 40, 41, which are disposed to extend across and maintain a control joint 42 between the adjacent floating platforms 10, 10' during relative movement of the platforms, e.g. due to wave action, changes in platform load or distribution, etc. Referring also to FIGS. 3 and 4, each SEA-BOLT™ platform connector assembly 40, 41 includes an elongate cylindrical core 44. In one implementation, the cylindrical core is a flexible cylindrical core formed, e.g., of reinforced rubber or other suitable synthetic material. The core is disposed to extend across the control joint 46 between opposed sidewall surfaces 24, 24' of adjacent floating platforms 10, 10'. The flexible cylindrical core 44 has a first end region 48 received within a first cylindrical disc assembly 62 secured between opposed sections 50, 52 of a first bolted c-clamp assembly 54 and fixedly attached to the sidewall surface 24' of the connector assembly cavity 38' of the floating platform 10' on an anchor plate 58 secured to the rigid structural body by bolts 60. The cylindrical disc assembly 62 engages securely in a corresponding, cooperating circumferential groove 66 defined by the flexible cylindrical core 44 in its first end region 46. The flexible cylindrical core 44 also has an opposite second end region (not shown) received within a second cylindrical disc assembly secured between opposed sections of a second bolted c-clamp assembly and fixedly attached to the sidewall surface 24 of the platform connector assembly cavity 38 of the floating platform 10 on an anchor plate secured to the rigid structural body by bolts 60. The second cylindrical disc assembly similarly engages securely in a corresponding, cooperating circumferential groove defined by the flexible cylindrical core 44 in its second end region.

Platform

The method and apparatus set forth above, with reference to the drawings, describe a floating platform 10, 10' that can be used in a singular or in multiple (joined together) applications. Such platforms can be used to support buildings, parks, swimming pools, and other activities associate with land-based development.

The dimensions and configurations of the platforms will vary depending upon, e.g., usage and calculated weight loads.

In one implementation, the prime components consist of reinforced concrete poured over a prearranged series of flotation foam blocks 12. Floatation foam can be syntactic foam, expanded polystyrene, or equivalent) capable of proving required buoyancy. (Note: the reverse could also apply whereby the concrete structure is precast and foam is poured into cavities.)

The flotation foam is placed so as to create a series of concrete beams 41, topping slabs 26, and column bases 28 to accept applied loads from one or more buildings constructed on the platforms. Exterior walls 24 of platforms 10, 10' will be formed with conventional concrete formwork.

The flotation foam blocks 12 are designed to provide a tapered, variably indented surface 16. This surface allows the concrete to lock the flotation foam blocks in place, and to absorb upward thrust of the buoyant elements. For purposes of description, the assembly may be termed "COR FLOTATION TECHNOLOGY™" or "CFT™".

Platform Connectors

Two or more floating platforms 10, 10' will be combined, i.e., joined together, by means of flexible platform connector assemblies 40, 41, i.e. "SEA BOLTS™." The SEA BOLT™ connectors hold the platforms in place, provided the desired degree of control across the intervening joints, and allow for dynamic wave and wind loading action. Implementations of this aspect of the disclosure may include one or more of the following additional features.

The basic SEA BOLT™ connector has a reinforced rubber (or suitable synthetic material) core element 44 of cylindrical shape. The opposite ends (e.g., first end 48) are clamped by preassembled c-clamp collars 54 that secure cylindrical disc assemblies 64 at each end to the cylindrical core. The respective disc assemblies 64 are provided with pre-drilled holes for fastening the respective ends of the platform connector assembly 40, 41 to bolt assemblies 60 embedded in platform connector assembly cavities 38, 39 defined in the opposed sidewalls 24, 24' of the adjacent floating platforms 10, 10'. The SEA BOLT™ connectors are accessed through control ports 68, e.g. for required maintenance, repair, and/or replacement.

A number of implementations of the invention have been described. Nevertheless, it will be understood that various modifications may be made without departing from the spirit and scope of the invention.

For example, in an alternative implementation, the elongate cylindrical core element 44 may be formed of a relatively more rigid or stiff material, e.g. a metal material, such as stainless steel.

Accordingly, other implementations are within the scope of the following claims.

What is claimed is:

1. A floating platform, comprising:

a structural support body, the structural support body comprising intersecting sidewalls to define a cavity therein, each of said sidewalls being substantially vertical and having upper and lower ends, and at least one topping slab supported proximate the upper ends of the sidewalls to define a construction surface; and a plurality of flotation block elements arranged within the structural support body, the flotation block elements arranged in a spaced-apart grid pattern within the cavity of the structural support body, wherein said flotation block elements each has top and bottom ends and a middle portion disposed between the top and bottom ends, an upwardly-tapering side surface extending between the top and bottom ends so that the bottom end is substantially wider than the middle portion and the top end, the upwardly tapering side surfaces further comprising substantially horizontal indentations, wherein the bottom ends of said flotation block elements are substantially coextensive with the lower ends of said sidewalls, and wherein the structural support body is supported buoyantly by the flotation block elements.

2. The floating platform of claim 1, wherein said flotation block elements are formed of foamed polymeric material.

3. The floating platform of claim 2, wherein the foamed polymeric material is selected from among syntactic foam and expanded polyethylene.

4. The floating platform of claim 1, wherein the structural support body is formed of reinforced concrete.

5. The floating platform of claim 4, wherein the structural support body is formed of precast concrete.

6. The floating platform of claim 4, wherein the flotation block elements are arranged in a predetermined pattern, and the intersecting sidewalls of the structural support body are formed about the flotation block elements.

7. The floating platform of claim 1, wherein the intersecting sidewalls of said structural support body are formed of reinforced concrete.

8. The floating platform of claim 1, wherein the at least one topping slab of said structural support body is formed of reinforced concrete.

9. The floating platform of claim 1, wherein the at least one topping slab of said structural support body further comprises multiple structural column bases.

10. An assemblage of a plurality of the floating platforms as described in claim 1, and further comprising:

one or more connector elements comprising:

a cylindrical body extending across a control joint between opposed sidewall surfaces of adjacent floating platforms, the cylindrical body having a first portion received within a first cylindrical disc assembly secured by a first clamp element and fixedly attached to a first of the opposed sidewall surfaces, and the cylindrical body having an opposite, second end portion received within a second cylindrical disc assembly secured by a second clamp element and fixedly attached to a second of the opposed sidewall surfaces, opposite to the first of the opposed sidewall surfaces.

11. The floating platform of claim 10, wherein the cylindrical body is a flexible cylindrical body.

12. The floating platform of claim 11, wherein the flexible cylindrical body is formed of reinforced rubber or other suitable synthetic material.

13. The floating platform of claim 11, wherein the cylindrical body is formed of stainless steel or other suitable stiff or rigid material.

* * * * *